United States Patent [19]

Mears

[11] 4,065,906

[45] Jan. 3, 1978

[54] METHOD AND APPARATUS FOR CONSTRUCTING BUILDINGS

[76] Inventor: Stowell Whitney Mears, 777 N. Ocean Blvd., Delray Beach, Fla. 33444

[21] Appl. No.: 694,408

[22] Filed: June 9, 1976

[51] Int. Cl.[2].... E04B 1/347; A45F 1/16, E04H/3/16

[52] U.S. Cl. ..... 52/745; 52/750; 135/1 R; 52/82; 52/86

[58] Field of Search..... 135/1 R, 135/2, 1 B, DIG. 1; 52/741, 63, 65, 222, 82, 745, 750, 80, 86; 254/65

[56] References Cited

U.S. PATENT DOCUMENTS

| | | | |
|---|---|---|---|
| 942,006 | 11/1909 | Morehead | 254/65 |
| 1,091,964 | 3/1914 | Rossman | 254/65 |
| 2,733,482 | 2/1956 | Doman | 52/63 |
| 3,057,119 | 10/1962 | Kessler | 52/63 |
| 3,473,272 | 10/1969 | Hasselquist | 52/222 |
| 3,708,944 | 1/1973 | Miyake | 52/745 |

*Primary Examiner*—John E. Murtagh
*Attorney, Agent, or Firm*—Geoffrey R. Myers; William D. Hall

[57] ABSTRACT

A method and apparatus for constructing a self-supporting, mountable and demountable prefabricated building structure comprised of a flexible integral sheet and a plurality of elongated flexible support members attached thereto, the building having substantial load-bearing capacity independent of cross members or interfering columnar supports, the method including simultaneously drawing inwardly the free ends of the supporting members against the opposite members into a rigid arcuate building structure. The apparatus comprising means for simultaneously drawing the free ends of the support members against the fixed ends, the means being connected at one end to the free ends of the support members and, at the other end, to a wind-up mechanism for effecting the simultaneous drawing in of the free ends.

26 Claims, 20 Drawing Figures

FIG. 13
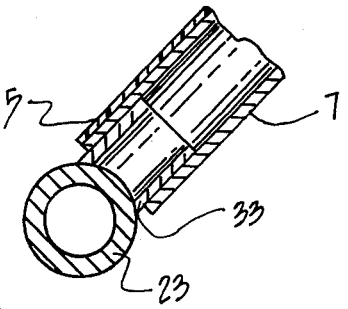
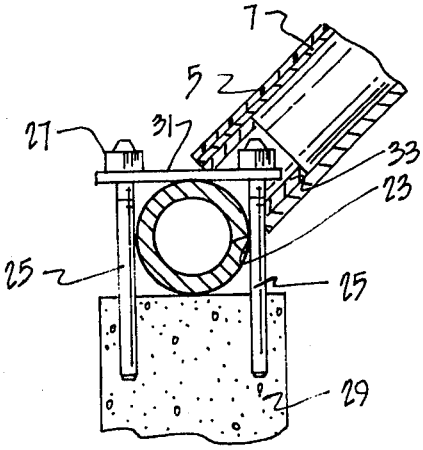
FIG. 14

METHOD AND APPARATUS FOR CONSTRUCTING BUILDINGS

This invention relates to a method and apparatus for constructing a prefabricated self-supporting, mountable and demountable, building structure. More particularly, this invention relates to a method and apparatus for constructing a prefabricated self-supporting, mountable and demountable, building structure which is sufficiently rigid to satisfy the structural requirements of building codes.

Techniques have been heretofore devised for constructing prefabricated building structures. While these techniques can be kept relatively simple for small flexible buildings, the problems and thus the techniques become increasingly more complex and expensive as one attempts to construct larger prefabricated buildings which are rigid and thus satisfy the structural requirements of building codes.

The usual technique for rendering buildings rigid, particularly those of large size, is to use complex cross-membering systems. Another technique is to employ internal air pressure. Both, at times, must be simultaneously employed. Many of these prior art techniques do not permit the building structure to be easily mounted and disassembled, and with some the building structures created are not easily transportable. Many other of the prior art techniques, without the use of additional complex cross-membering or interfering columnar structures or internal pressure, do not create sufficiently rigid building structures capable of complying with the structural requirements of applicable building codes for that structure. Still other prior art techniques require the building to be completed in piecemeal fashion rather than as a single unitary structure.

It is apparent from the above that there exists a need in the art for a method and apparatus for constructing a prefabricated self-supporting, easily mountable and demountable, building structure capable of satisfying the structural requirements of building codes or which is otherwise rigid and capable of sustaining acceptable longitudinal, lateral and vertical loads without additional cross-membering or interfering columnar structure, and yet is constructable as a complete unitary structure.

The term "rigid" is used herein in accordance with its accepted meaning to indicate a structure which exhibits no substantial flexing under load. The term "interfering columnar" means a column which extends substantially vertically from the roof into and through the "room area" and is connected to its own separate footing in the room floor.

It is a purpose of this invention to fulfill the above-described need in the art, as well as other needs which will become more apparent to those skilled in the art once given the following detailed description of the invention.

The purposes of this invention are generally fulfilled by a method of constructing a self-supporting, mountable and demountable, prefabricated building structure which includes a flexible integral sheet and a plurality of elongated flexible support members attached thereto, the steps comprising:

a. positioning the sheet and support members over the area to be covered by the building, b. securing one of the ends of the support members against lateral movement, thereby to define a secured end and a free end of each of the support members, c. elevating portion of the support members to a height less than the peak of the completed building, d. drawing substantially simultaneously each of the free ends of said members against the secured ends until a building of the desired size is obtained, and e. anchoring the free ends to thereby form said building structure.

The unique apparatus of this invention for constructing the aforesaid self-supporting, mountable and demountable, prefabricated building structure, comprises a. means for securing one of the ends of the support members against lateral movement, thereby to define a secured end and a free end of each of the support members, b. means for elevating an intermediate portion of the support members to a height less than the peak of the completed building, and c. means for drawing the free ends of the support members substantially simultaneously against the secured ends until a building structure of the desired size is obtained, and d. means for anchoring the free ends of said support members.

The methods and apparatus of this invention may be uniquely employed so as to construct a self-supporting, mountable and demountable, prefabricated rigid building structure capable of substantial load-bearing capacity independent of cross members and interfering columnar supporting structures, and thus capable in preferred embodiments of satisfying the structural requirements of local building codes even though the buildings are of substantially large size.

The term "substantially large size" is used herein to designate a building having a span of greater than about 25 feet and usually greater than about 30 feet.

This invention will now be described with reference to certain specific embodiments and illustrations, wherein:

IN THE DRAWINGS

FIGS. 13 and 14 are side partially sectionalized views illustrating an anchoring means for the support members.

Figure 1:
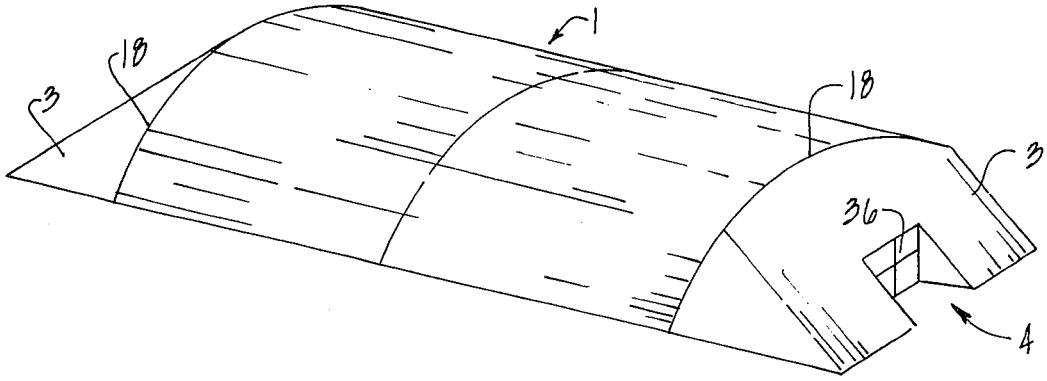
FIG. 1 is a perspective view of a completed cylindrically-arched, prefabricated building structure which may be constructed according to this invention.
Figure 2:
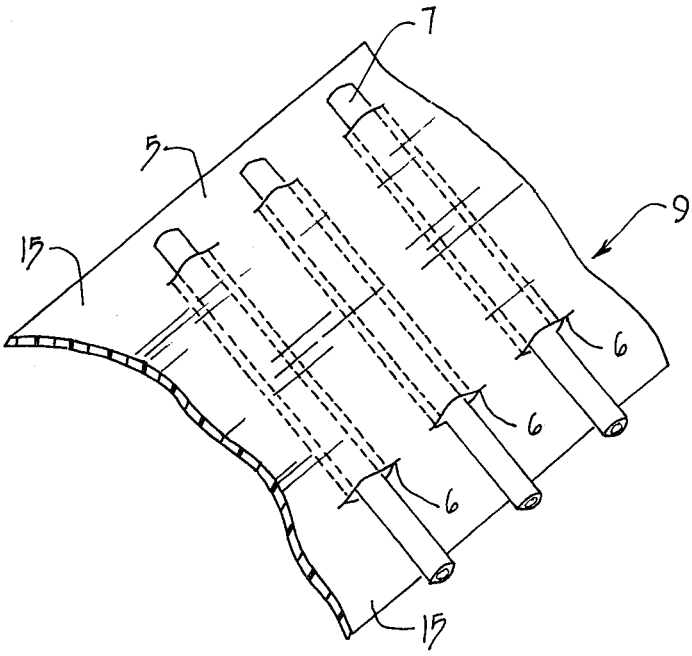
FIG. 2 is a partial cross-sectional view of a flexible sheet with support members located therewithin, useful in producing buildings according to this invention.

Referring to the drawings, and particularly FIGS. 1–6, there is illustrated a self-supporting, mountable and demountable, prefabricated rigid building structure 1 capable of withstanding substantial vertical and horizontal loads and withstanding maximum wind and snow loads without substantial depression (i.e., flexing), independent of additional supporting structure. The building is generally cylindrical in shape with tapering end sections 3 and entrance part 4. When built according to this invention it will generally conform to the structural requirements of local building codes.

While building codes may vary with location and time, structures are usually said to conform to the applicable provisions of the code if they can withstand certain load capacities usually without any substantial flexing or deformation, since such action would tend to oscillate and/or otherwise eventually destroy the building. A typical example of such a code is the "Southern Standard Building Code," 1973 Southern Building Code Congress, wherein the following are exemplary:

"§1203.2 — ROOF LIVE LOADS

"(a) Where the rise is less than thirty degrees (30°), roofs shall be designed for a vertical live load only of not less than twenty (20) pounds per square foot of horizontal projection applied to any and all slopes; when the rise is greater than thirty degrees (30°) the roof shall be designed for wind load only.

"(b) Design requirements for wind pressures shall be as specified in Section 1205.3.

"(c) Roofs intended for use as floors, shall be designed for the floor live load, determined by the intended occupancy, Section 1203.1(a).

"§1205.1 — MINIMUM DESIGN LOADS

"(a) Buildings or other structures shall be capable of withstanding the horizontal loads shown in the following table and, applied in each zone, allowing for wind from any direction. The first height zone shall be measured above the average level of the ground adjacent to the building and the subsequent height zones shall be added progressively upward to the overall height of the building.

"DESIGN WIND PRESSURE FOR VARIOUS HEIGHT ZONES OF BUILDINGS OR OTHER STRUCTURES

| Height Zone Ft. | Lb./Sq. Ft. Horizontal Loads | |
|---|---|---|
| | For Southern Inland Regions | For Southern Coastal Region* |
| Less than 30 | 10 | 25 |
| 31 to 50 | 20 | 35 |
| 51 to 99 | 24 | 45 |
| 100 to 199 | 28 | 50 |
| 200 to 299 | 30 | 50 |
| 300 to 399 | 32 | 50 |
| Over 400 | 40 | 50 |

"*Coastal region is defined as that area lying within 125 miles of the coast and subject to hurricanes, tropical disturbances and occasional winds attaining exceptionally high wind velocities. (See Appendix "D" for Hurricane Requirements.)

"(b) Allowance to be made for shape factors are as follows:

"(1) Round or eliptical structure sixty percent (60%) of basic allowable pressure.

"(2) Hexagonal or octagonal structures eighty percent (80%) of basic allowable pressure.

"(3) Rectangular or square structure 1.00 times basic allowable pressure.

"(c) Correction factors for trussed towers with flat, angular or cylindrical members shall be determined by qualified structural designers but in no case shall be less than those recommended by the United States of America Standards Institute.

"§1205.2 — EXTERIOR WALLS

"Every exterior wall shall be capable of withstanding the loads specified in the above table, acting either inward or outward.

"§1205.3 — WIND LOADS

"(a) The roofs of all buildings or other structures shall be designed to withstand loads acting outward normal to the surface equal to one and one-quarter (1¼) times the horizontal loads specified for the corresponding height zone in which the roof is located. The height is to be taken as the mean height of the roof structure above the average level of the ground adjacent to the building or other structure. The load is to be applied over the entire roof.

"(b) Roofs with slopes greater than thirty degrees (30°) shall withstand resulting loads acting inward normal to the surface equal to those specified for the height zone in which the roof is located, the load to be applied to the windward slope only.

"(c) Overhanging caves and cornices shall be capable of withstanding upward loads equal to twice those specified.

"(d) Adequate anchorage of the roof to the walls and columns and of walls and columns to the foundations shall be required in all cases."

In certain preferred embodiments, building structure 1 will conform to this Code after it is constructed according to this invention.

Building structure 1 comprises (with reference particularly to FIGS. 1, 5 and 6) a flexible integral sheet 5 and elongated flexible support members 7 attached thereto. In the embodiment of a cylindrically arched building structure, such as shown in FIG. 1, the support members 7 are attached to the sheet 5 in parallel and evenly spaced from each other. Attachment may be by conventional technique to enable each section 9 to be rolled and easily transported as hereinafter described. In the illustrated embodiment of FIG. 2, pockets 6 are created in sheet 5 for retaining supports 7. This enables tightening of sheet 5 after building erection by tight anchoring of flaps 15. Other techniques include adhesive or mechanical bonding of sheet 5 to support 7.

The support members 7 are sufficiently rigid when flexed to be of substantial load-bearing capacity thereby to form the desired buildings, but sufficiently resilient to be capable of being forcibly flexed into an arcuate configuration along their respective longitudinal axes. Members 7 may be made of any convenient material. In the preferred embodiments, support members 7 are hollow, tubular, glass fiber reinforced epoxy bonded pipe, or more preferably, hollow tubular aluminum pipe — of the requisite size, thickness, etc., to accomplish the intended purpose. An example of such pipe useful for constructing building 1 of substantially large size is a 2-inch hollow aluminum pipe of 0.154 inch wall thickness and about 40 feet in length.

Flexible sheets 5 are generally rectangular sheets preferably made of plastic fabric so that prefabricated rectangular fabric sections (i.e., panels) 9 may be rolled in the longitudinal direction, about support poles 7 into a compact transportable configuration, thereby allowing building structure 1 to be easily transported before construction and after disassembly. A particularly preferred plastic fabric sheet material is a laminate structure composed of glass fiber fabric coated with vinyl or Teflon or both. Other materials that can be employed for sheet 5 include a polyester or nylon fabric, reinforced corrugated fiberglass sheet or a metal sheet material. As can be seen, the above materials provide an inexpensive way of constructing a prefabricated, mountable and demountable, self-supporting building structure 1.

Depending upon the desired size of building structure 1, a plurality of prefabricated rectangular panels or sections 9, conveniently (for manufacturing, transporting and handling purposes) on the order of about 40–45 feet in width), may be joined together by suitable coupling means, to form a unitized prefabricated panel of the desired size. The length may be indefinitely long and is governed by convenience in regard to the size (diameter) of the roll for handling purposes.

Figure 3:
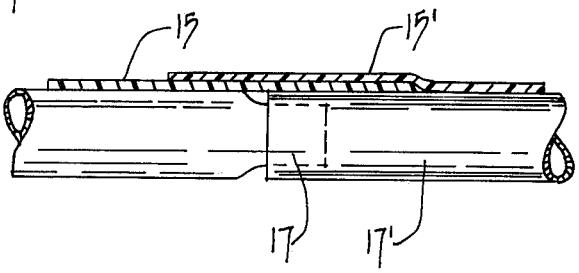
FIGS. 3 and 4 are partially sectionalized side plan views illustrating certain modes of connecting a plurality of flexible integral sheets together for producing substantially large sized buildings.
Figure 4:
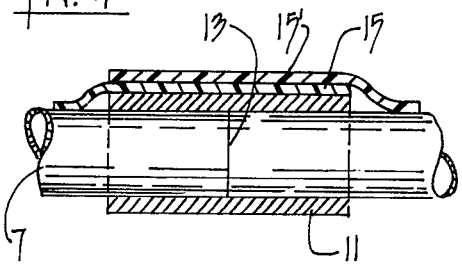

FIGS. 3–4 illustrate two techniques for joining panels 9 together. In FIG. 4, the ends of support members 7 and 7′ are fitted so as to form a butt joint 13 after a sleeve coupling 11 is inserted over the respective ends of support members 7 and 7′ and under the flaps 15 and 15′ of the respective flexible sheets 5 and 5′, and sleeve coupling 11 is bonded to support members 7 and 7′ so as to hold butt joint 13 intact. Sleeve coupling may be held in place by bolt means (not shown) if necessary. The flaps 15 and 15′ of the flexible sheets 5 and 5′ are then bonded to each other and to sleeve coupling 11 to provide a watertight seal in the form of a bonded lap joint. Bonding can be by way of glue, heat or both, or alternatively can be done by conventional grommet technique.

In FIG. 3, another means for coupling prefabricated rectangular panels 9 together is illustrated. Support members 7 and 7′ are formed having a male end 17 and a female end 17′ to facilitate coupling prefabricated rectangular panels 9. Flaps 15 and 15′ are bonded as previously described.

From this technique, a building structure of substantially large size can be obtained with rigid characteristics and capable of substantial load-bearing capacity, independent of additional supporting structure. For example, the building structure 1 may be utilized for such varied purposes as a tennis stadium, a greenhouse, an airplane hangar, and many other uses.

In the preferred embodiments of the cylindrically-arched building structures, stabilizing end sections 3 are attached to the opposite arched ends 18 of the flexible sheet 5, as hereinafter described, so as to tighten, longitudinally, structure 1 and make it even stronger. Stabilizing section 3 also serves the purpose of fully enclosing structure 1.

THE METHOD OF CONSTRUCTION

Upon ascertaining the desired size of building structure 1, the necessary number of prefabricated, easily transportable panels 9 are brought to the job site, unrolled and if required, are joined by suitable coupling means (e.g., FIGS. 3 or 4), the unrolling positioning the unitized panels over the area to be covered by building structure 1 such that support members 7 are positioned under flexible sheet 5. The ends of support members 7 on one side of the panel configuration (location "A" in FIGS. 5 and 6) are then pivotally anchored to the ground by a suitable means such as that illustrated in FIGS. 13 and 14. In these Figures, anchor means 23, preferably in the form of a shaft or tube which extends the length of the panel sections, has a plurality of projections or shafts 33 mounted parallel to each other and perpendicular and radial to shaft 23 and in axial alignment with the corresponding support member 7 of the panel. Projections 33 have an outside diameter slightly less than the inside diameter of support member 7 so that projections 33 of shaft 23 can be press-fit into the ends of tubular support member 7 as illustrated in FIG. 13.

Shaft 23 is then bolted to the foundation (footing) 29 by bolts 25 embedded in foundation 29. Foundation of footings 29 may be individual, or one continuous footing extending the length of structure 1. Foundation 29 is preferably made of concrete.

A bracket or plate 31 is mounted over the ends of bolts 25 to lock shaft 23 in place when nuts 27 are threaded onto the ends thereof as shown in FIG. 14. Care is taken in bolting shaft 23 to the foundation so as to prevent lateral and vertical movement of the shaft 23 while at the same time allowing shaft 23 to pivot in its housing so as to prevent buckling of the panel and/or loosening or tearing out of foundation bolts 25 when the unanchored ends of support members 7 of panel are drawn toward the anchored ends of support members 7 as hereinafter described. Upon completion of the building structure 1, shaft 23 is then firmly secured to foundation 29 so as to prevent any lateral, vertical, or substantial amount of rotational movement. Foundation 29 and bolts 25 are pre-loaded in the proper position so that by lifting shaft 23 and its placement between opposing bolts 25, anchoring is easily accomplished.

Figure 10:
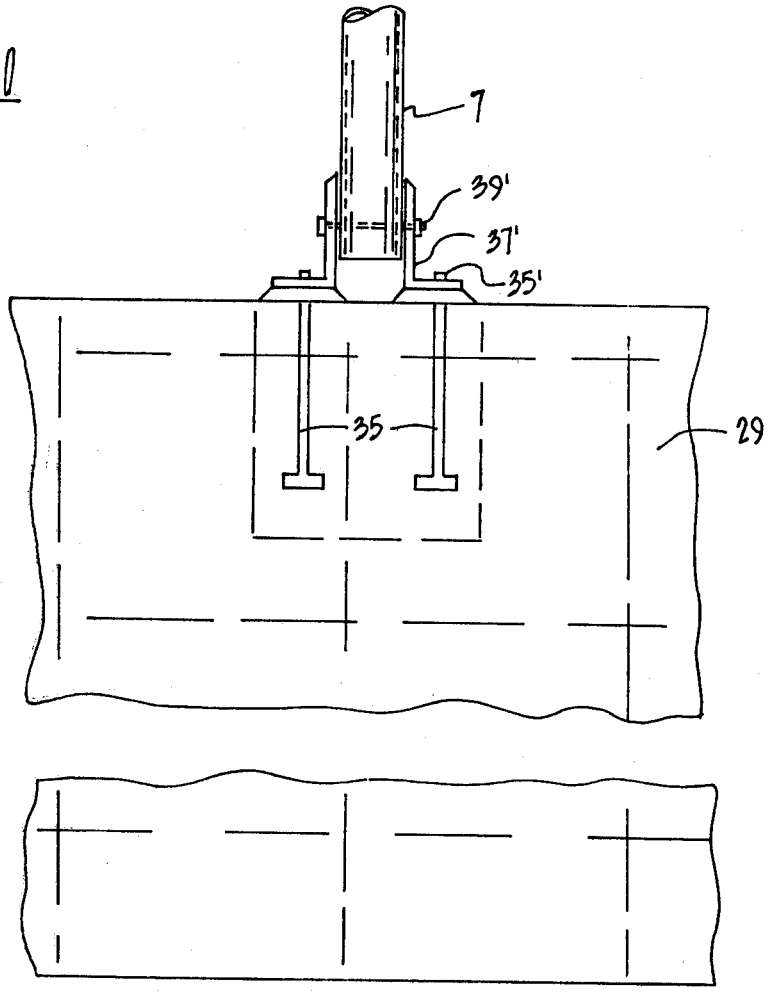
FIG. 10 is a partially sectionalized view of an anchoring means for the support members.

Another suitable means for pivotally anchoring the ends of tubular support members 7 is illustrated in FIG. 10 whereby support members 7 are allowed to pivot by pivot pins 39′. Pivot pins 39′ connect support members 7 to base bracket 37′ which is firmly secured to foundation 29 by means of bolts 35. In this embodiment, shaft 23 is eliminated, thus saving the cost of such a shaft, but necessitating separate anchoring of each individual support 7. Brackets 37′ are pre-located so as to be correctly positioned for aligning supports 7 in a substantially parallel spaced configuration.

Upon pivotally anchoring the ends of support members 7, the opposite unanchored or free ends of support members 7 (location "B" in FIGS. 5 and 6) are connected to a means capable of substantially simultaneously drawing the free ends of the support members 7 against and toward the anchored ends. A suitable means for performing this is illustrated in FIGS. 5 through 9 and will be discussed in detail hereinafter. Generally speaking, such apparatus includes a wind-up mechanism connecting all of the free ends to a "central" rotatable shaft which when rotated will simultaneously flex and tense supports 7.

Figure 5:
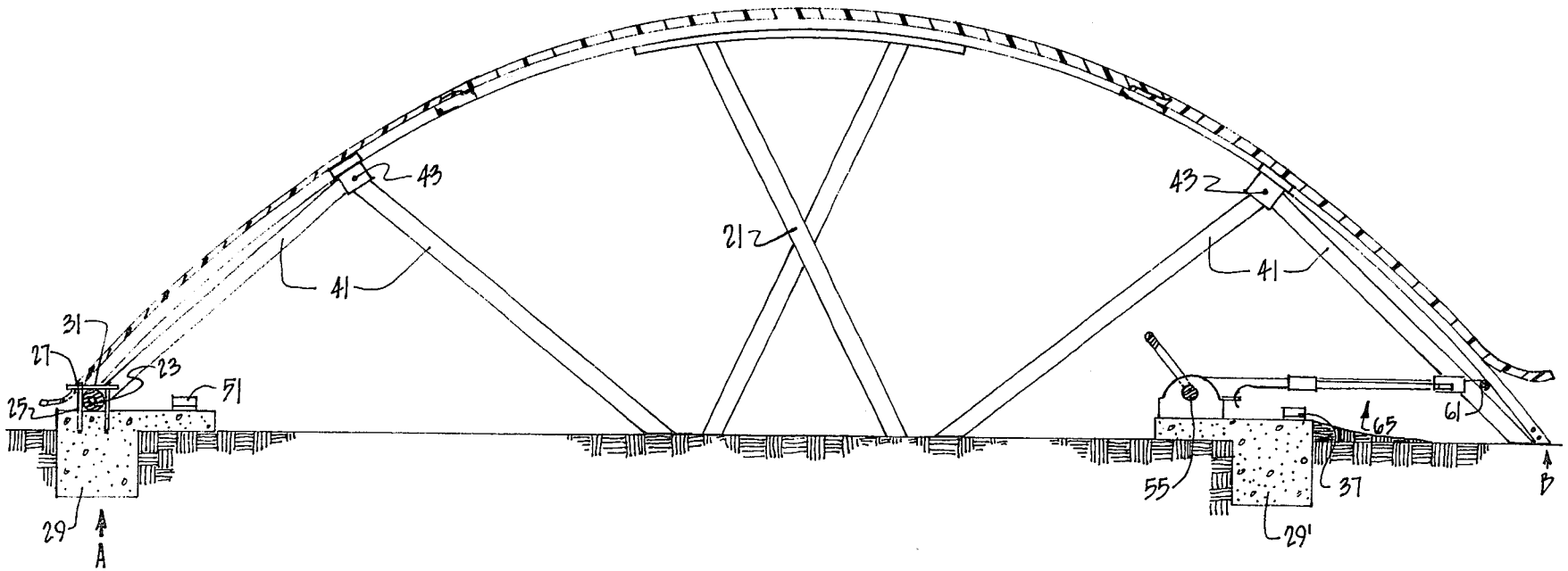
FIG. 5 is a side plan view of a building under construction and an embodiment of the apparatus for constructing it.

To initiate the flexing process, the central portion of support members 7 is elevated by a means located between the opposing ends of support members 7 to a height substantially less than the ultimate height of the building but sufficient to initiate flexing. A suitable means 21 is illustrated in FIG. 5 and may consist of an "X" frame with flexible plywood flap top located at the center of support member 7. Other means may be used but the "X" frame distributes the force over a wider area, thus protecting member 7 from damage. It is not always necessary to provide a member 21 for each support member 7, but in many instances it is preferred. In other instances only enough members 21 need be provided to elevate the structure with sufficient uniformity to initiate flexing. Initial heights (i.e., elevation) of about 8 feet are adequate to initiate flexing for buildings of substantially large size and ultimate heights of about 35 feet or more at peak.

Figure 12:
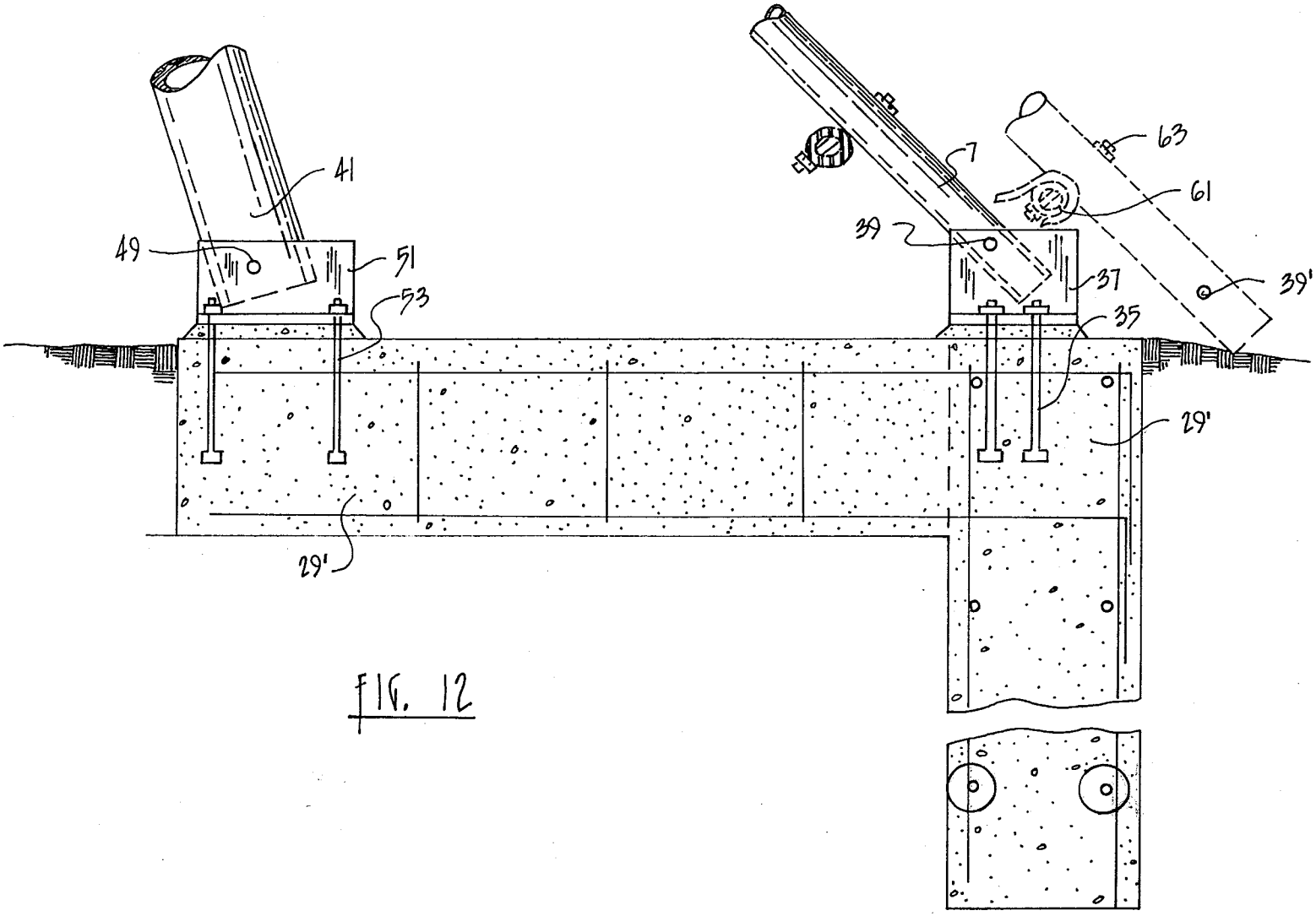
FIG. 12 is a side partially sectionalized view illustrating an anchoring means for the support and brace members.

As the free ends of supports 7 are drawn in against their anchored ends via the rotation of the wind-up mechanism, the building is raised and means 21 fall away. This drawing or flexing process continues until an arcuate building structure 1 of the desired size is obtained (as predetermined by the location of footings 29' and anchoring brackets 37, FIG. 12) whereupon the unanchored ends of support members 7 are anchored to footing 29' by suitable means as illustrated in FIG. 12, which basically uses the same elements as were employed in and described with reference to FIG. 10. FIG. 12 illustrates in dotted-line fashion how support 7 is drawn in across the ground "G" and into and between opposing brackets 37 where it is eventually anchored via holes 39 and 39' with pin or bolt means.

In certain preferred embodiments of this invention and with reference to FIGS. 5, 6, 11 and 12 in particular, support members 7 are provided with brace members 41 pivotally attached thereto at one end and initially unanchored at the other end (see FIG. 5). The purpose of these brace members 41 is two-fold. First, by eventually anchoring members 41 to the same footing 29 or 29', as support member 7, additional strength and stability of the completed building structure 1 without the use of cross-members or interfering columnar supports is obtained. Secondly, by selective initial arrangement of braces 41 they act as aides in the erecting process, as hereinafter described.

Figure 11:
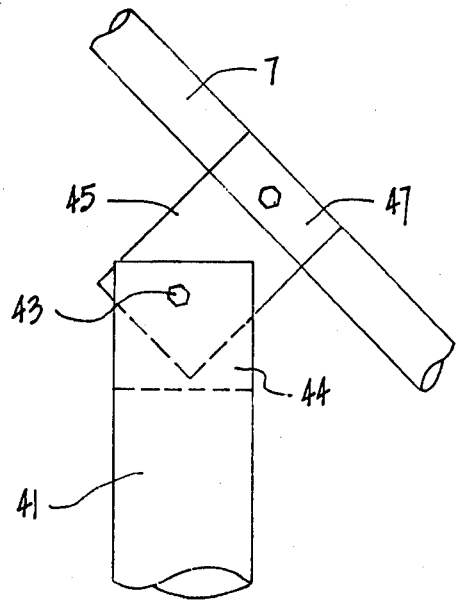
FIG. 11 is a side plan partially sectionalized view illustrating an attachment for a brace member to a support member.

With reference to FIG. 11, brace members 41 may be connected to support members 7 by a suitable collar means 47. Brace members 41 are pivotally attached by pin 43 to plate 45 which is permanently attached to collar 47 surrounding support member 7. Brace 41 is provided with end notch 44 into which plate 45 slides and pivots, thus to allow rotation but not lateral movement of brace 41.

Figure 6:
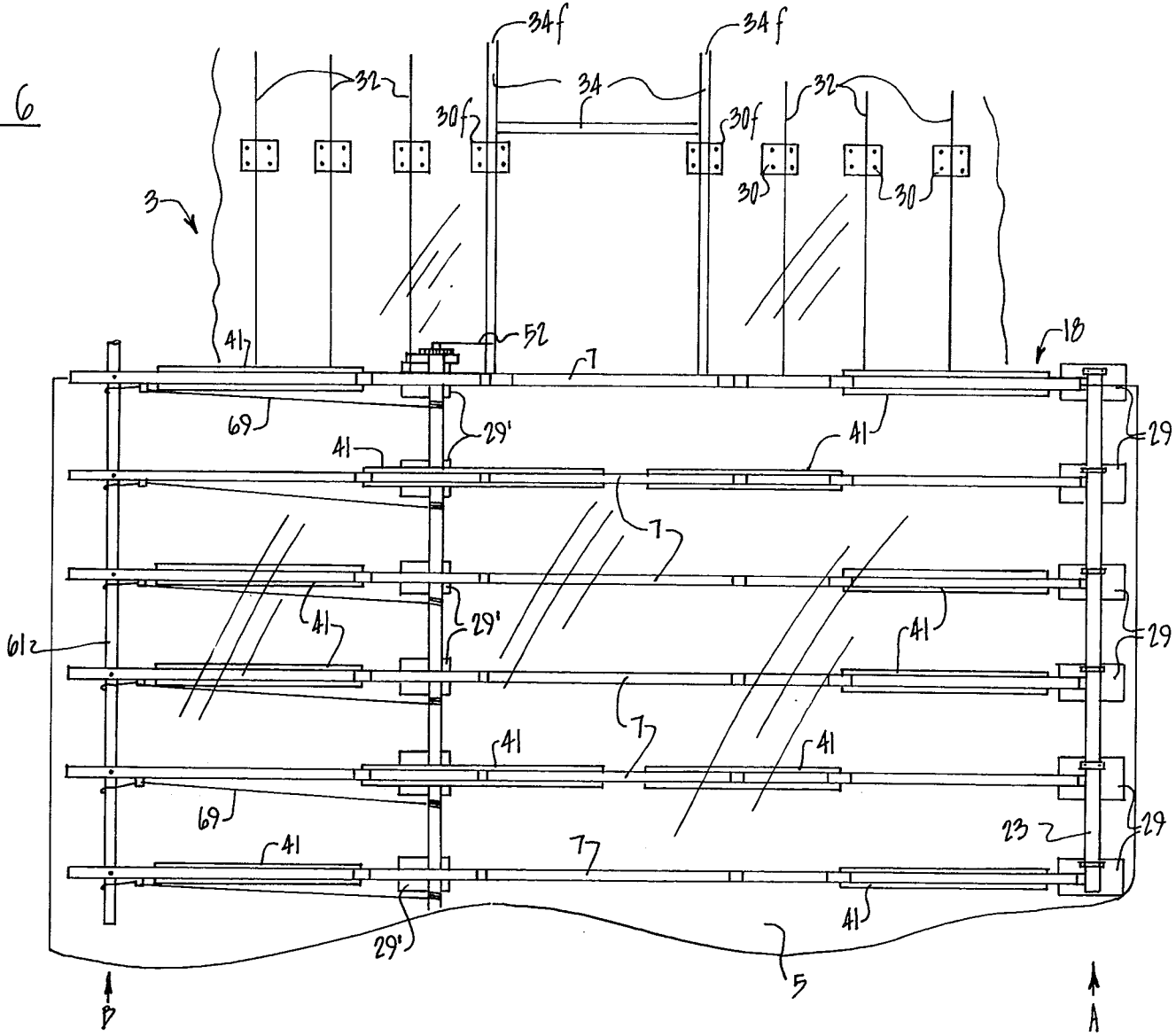
FIG. 6 is a partial top plan transparent view of the support members, flexible sheet and apparatus for constructing a building structure according to this invention.

As the building structure 1 is raised, pivot pin 43 allows brace member 41, initially in a flat, horizontal position, to pivotally recede, whereby the unanchored ends of brace member 41 are in constant contact with the ground and thus forming stabilizing supports for the building structure 1, while the unanchored ends of support members 7 are drawn towards the anchored ends. As illustrated in FIG. 6, by initially laying certain braces 41 in one direction (e.g., inward) and the remainder in the other direction (e.g., outward), as the building is raised, a triangular support (FIG. 5) is created to stabilize the building against wind gusts and the like. Brace members 41 laying inward are also used to insure that an arcuate shape is maintained as the building rises. This is accomplished by moving these members 41 toward the footings periodically as the erecting process progresses and particularly after means 21 has fallen away.

Upon obtaining the desired building size, the unanchored ends of the brace members 41 are anchored by suitable means to footings 29 or 29' so as to provide increased load-bearing capacity and to withstand wind and snow loads without substantial depression but without interfering extension into the room area. A suitable means for anchoring the unanchored ends of brace members 41 is illustrated in FIG. 12. The unanchored end of brace member 41 is anchored between and to opposing base brackets 51 by pivot pin 49, and brace brackets 51 are secured to foundations 29 or 29' by bolts 53. In those instances where bolts 53 on foundation 29' have been used to retain pillow block 201, pillow block 201 is first removed before installing brackets 51.

In certain preferred embodiments of this invention, the building structure 1 is further stabilized after erection by tensioning the flexible sheet 5 from end to end via the use of end sections 3. This may also be used to finish off the building by closing off the ends. Section 3 as shown in FIG. 6 is provided with its own footings 30, guide means (e.g., guy wires) 32 and poles 34. Guy wires (cables) 32 and poles 34 may be connected conventionally to the nearest (first or last) support member 7. Poles 34 may be, but are not usually, flexed before connecting their free ends 34*f* to their respective footings 30*f*. Poles 34 provide a firm structure for doorway 36. Guy wires 32 are employed with poles 34 to longitudinally stress the building structure by tightly anchoring guy wires 32 and pole 34 on either end of the structure 1, thereby longitudinally stabilizing the building. Poles 34 may be anchored by the structure illustrated in FIG. 10. Guy wires 32 may be anchored by conventional turn buckle means. Such longitudinally stabilizing means increases the load-bearing capacity of the building and allows the building to better withstand wind and snow loads without substantial depression and without having to employ cross-members, interfering columnar structures or internal air pressure. Section 3's supporting members 32 and 34 are preferably covered with the same material as sheet 5, thus serving the further purpose of enclosing the building structure 1 aesthetically so as to be utilizable during all seasons and under all weather conditions.

Figure 15:
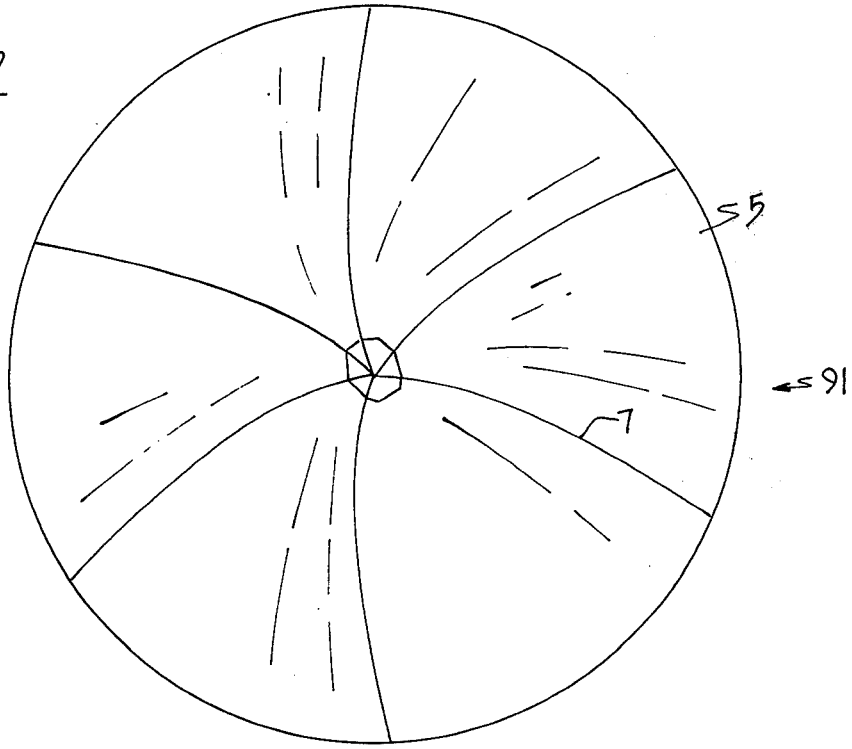
FIG. 15 is a top plan view of a semi-hemispherical domed structure constructed according to this invention.

Although a semi-cylindrical shaped building structure 1 has been described in this application, the building shape is not limited to this configuration. Other configurations that may be utilized in this invention include semi-hemispherical domes, donut-shaped domes, and the like. For example, FIG. 15 illustrates a semi-hemispherical domed building structure 91 which includes flexible sheet 5 and support members 7 that may be constructed according to this invention. Support members 7 are connected to the underside of flexible sheet 5 and are fixedly connected to circular ring 93

(FIGS. 16 and 17) at the center of the panel so as to prevent longitudinal and lateral movement. Circular ring 93 may be made of any suitable material so as to withstand the normal forces that will be applied to circular ring 93 upon drawing of the free ends "*f*" of support members 7 against the ends "*a*" attached to the ring 93.

Figure 16:
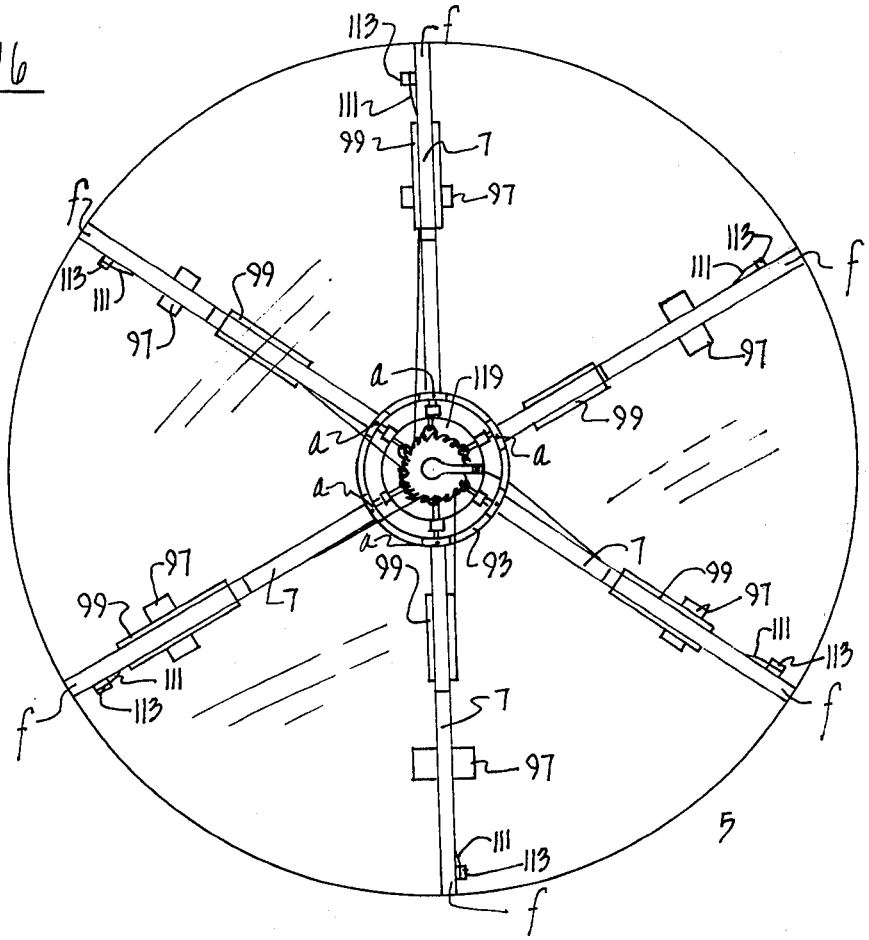
FIG. 16 is a top transparent view of the building structure in FIG. 15 and apparatus used to construct it.
Figure 17:
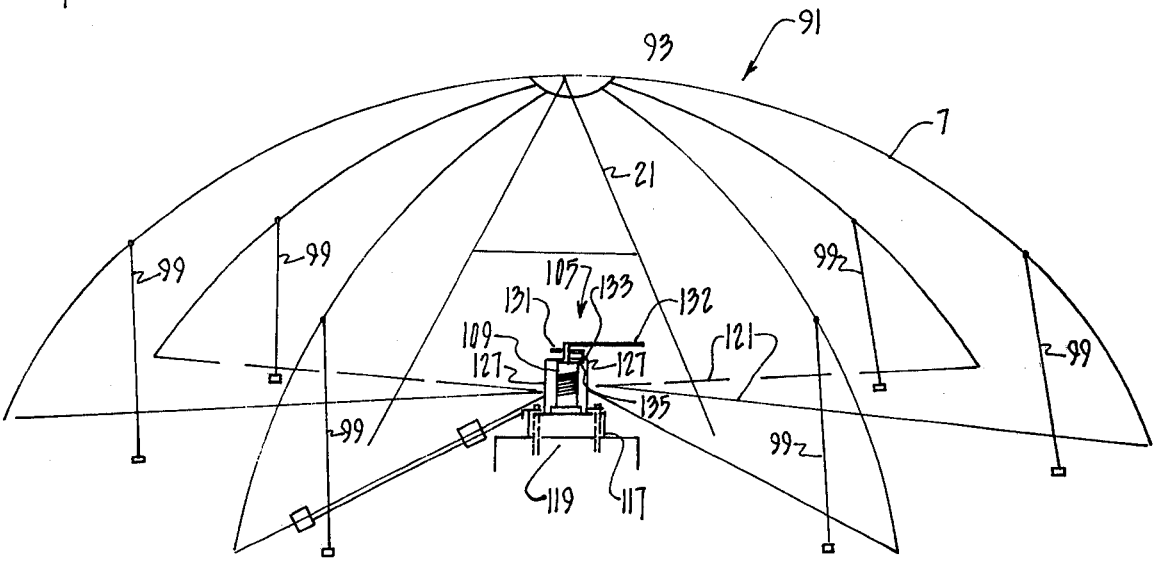
FIG. 17 is a three-dimensional schematized view of the building structure of FIG. 15 and apparatus used to construct it.
Figure 18:
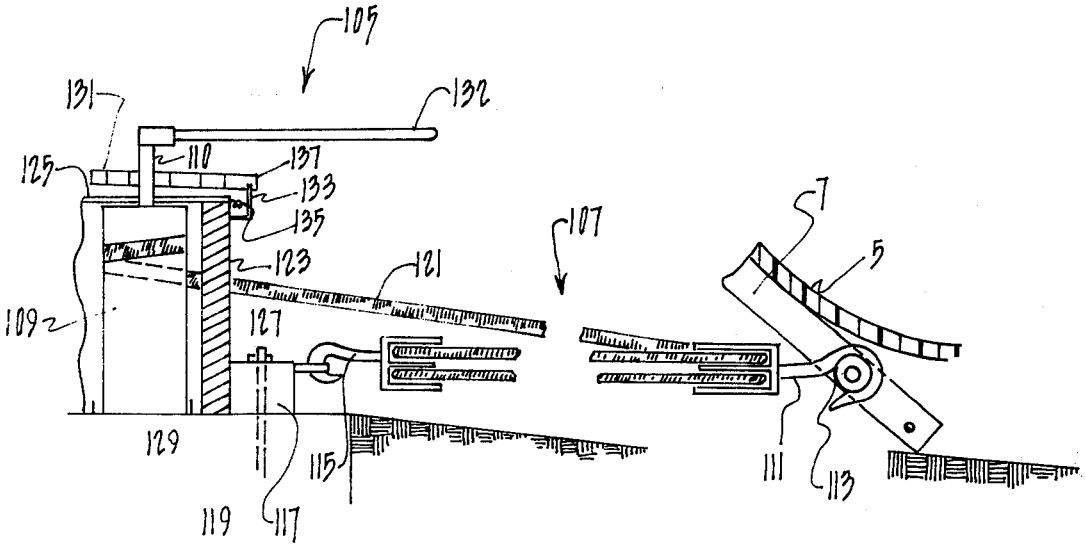
FIG. 18 is a side plan partially sectionalized view of the apparatus for constructing the building structure of FIG. 15.

Upon attaching the ends "*a*" of support members 7 at the center to circular ring 93, the ends "*f*" of support members 7 are connected to a means capable of simultaneously drawing the unattached ends "*f*" of the support members 7 against the attached ends "*a*." A suitable means for performing this is illustrated in FIGS. 16–18 and will be discussed hereinafter. Generally speaking such a means includes a wind-up mechanism for simultaneously drawing ends "*f*" radially inwardly toward the center of the base of the dome as ring 93 elevates to its desired height.

To initiate the construction, the flat prefabricated panel is laid out as shown in FIG. 16 after footings 97 have been set in the ground at the desired location. The structure is then initially elevated by a means 21 (FIG. 17) located at the center of building structure 91. The same considerations as to initial heights hereinbefore described are applicable here. A suitable means 21 may be a simple vertical pole or as schematically shown, an "A" frame construction connected to an appropriate portion of the ring 93 or provided with a plywood top flap, or as illustrated in FIG. 5 an "X" frame construction with flexible top flap. The purpose of such means 21 in regard to a semi-hemispherical domed building structure 91 is to initiate the flexing and elevation of the building structure; that is, to prevent the center ring 93 from being forced into contact with the ground while support members 7 are arched into a dome building structure. Another purpose of means 21 is to provide an initial raising and arching of building structure 91 so as to provide a space for the wind-up mechanism to be utilized in the center of the building. As the building structure 91 is raised, the elevation means 21 falls away and is not needed anymore.

Upon operation of the wind-up mechanism, the free ends "*f*" of support members 7 are drawn in against the attachment at ends "*a*," thereby forcibly flexing support members 7 until an arcuate building structure 91 of the desired size is obtained, whereupon the unattached ends of support members 7 are anchored to footings 97 by the same mechanism as illustrated in FIG. 12.

As previously discussed in relation to the semi-cylindrical building structure 1, building structure 91 has support members 7 which have brace members 99 pivotally attached thereto at one end and unanchored at the other end for further stabilizing the building structure during construction and thereafter enhancing the stability of the completed building structure 91. Brace members 99 are attached to support members 7 in the same manner and for the same purposes as previously discussed and as illustrated in FIG. 11. Brace members may be initially presented in one direction or alternately pointed inwardly and outwardly as illustrated thereby to provide a triangular support during elevation. Upon obtaining the desired building size, the unanchored ends of brace members 99 are anchored by suitable means, as previously discussed with respect to FIG. 12 to footing 97 so as to provide increased load-bearing capacity and to help the building withstand maximum wind and snow loads without substantial depression.

Figure 19:
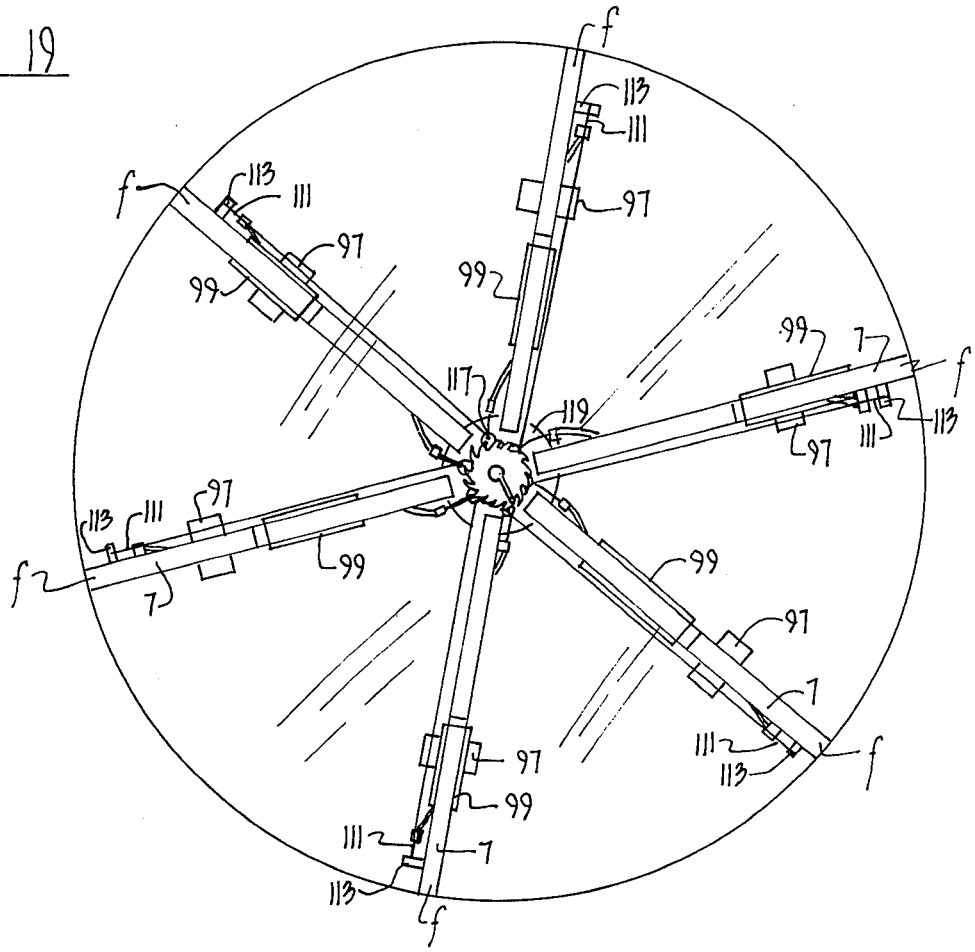
FIG. 19 is a top sectionalized view of a donut-shaped building structure and apparatus for constructing same.
Figure 20:
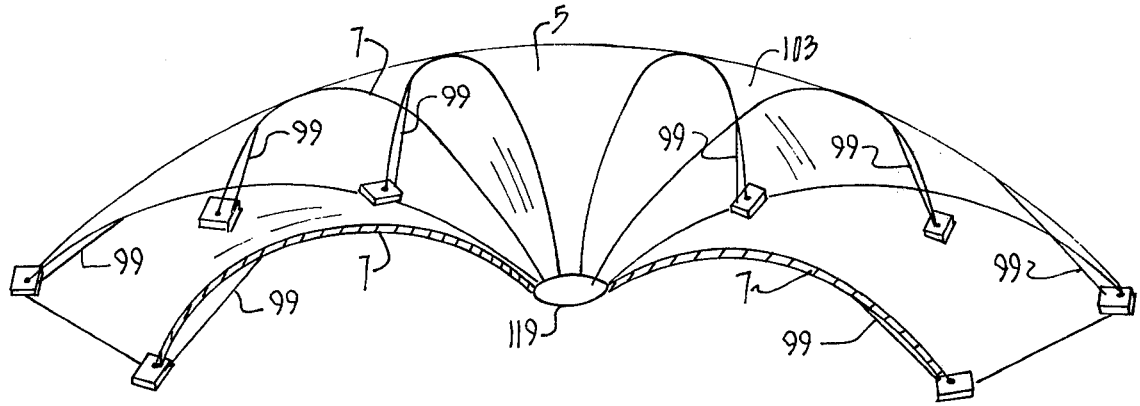
FIG. 20 is a three-dimensional partially sectionalized schematized view of the donut-shaped building structure of FIG. 19.

As a further example of different shapes possible from this invention, FIG. 20 illustrates a donut-shaped structure 103 whereby the ends of tubular support members 7 at the center are pivotally attached to foundation 119 instead of an elevatable ring 93. The building structure 103 is then created by a similar method as previously described in regard to the semihemispherical building structure 91. The apparatus, as illustrated in FIG. 19 will be discussed hereinafter, but is in all substantial aspects similar to that of FIG. 16, except that sheet 5 is initially not sealed to supports 7 at the inner attached or anchored ends so as to allow the block and tackle (i.e., wind-up) mechanism to extend under sheet 5. After the building is constructed then this remaining portion of sheet 5 is sealed to support 7.

It will be readily apparent to one skilled in the art that the completed buildings of this invention are and may be free of any interfering columnar members or connecting transverse or cross-members above ground level and yet are capable of satisfactorily withstanding vertical and horizontal loads to which the structures are being subjected and withstanding wind and snow loads without substantial depression. It is also readily apparent that the completed buildings are sufficiently rigid to comply with the structural requirements of applicable building codes for that structure.

Through the tensioning and compression created in the supporting members and the strength of now available light fireproof fabrics, the ability of the structures created by this method to eliminate the cross members and/or columnar supports provides maximized strength per pound of material weight. This is an important consideration in any building project.

THE ERECTING APPARATUS

FIGS. 5–9 illustrate an embodiment of the unique apparatus of this invention for erecting (i.e., constructing) the aforesaid building structures such as that illustrated in FIG. 1. Generally speaking such an apparatus includes a means for securing one of the ends of support 7 against lateral movement, means 21 for initially elevating supports 7, a rotatable wind-up shaft 55 (FIG. 8), a mechanism for rotating shaft 55 generally indicated at 57 (FIG. 9), means generally illustrated at 59 (FIG. 8) extending between shaft 55 and the free ends of support 7 for drawing substantially simultaneously the free ends in toward footing 29' when shaft 55 is rotated and means for anchoring the free ends of supports 7 once so drawn to their desired location.

In certain preferred embodiments of this invention wherein a semi-cylindrical structure 1 is being erected, means 59 may advantageously include a shaft 61 extending perpendicular to support means 7 and attached near the free ends thereof by any convenient structure such as bolt means 63. Shaft 61 thereby serves to connect all of the free ends of supports 7. As illustrated best in FIGS. 5 and 12, shaft 61 is located a sufficient distance from the end of support 7 so that it will clear brackets 37 when supports 7 are drawn therewithin. By connecting supports 7 together in this fashion, they will move substantially simultaneously during the drawing process. An alternative to shaft 61 is merely to provide a hole or bolt on support 7 for connecting to hook 67. This simplifies the apparatus, but sacrifices to "co-ordination" of all supports 7 achieved by shaft 61. It further necessitates the use of a block and tackle hook 67 for each footing. Usually, e.g., where brackets 37 are already in place, this connection for hook 67 should be located to avoid interference with brackets 37 during the drawing process.

Figure 7:
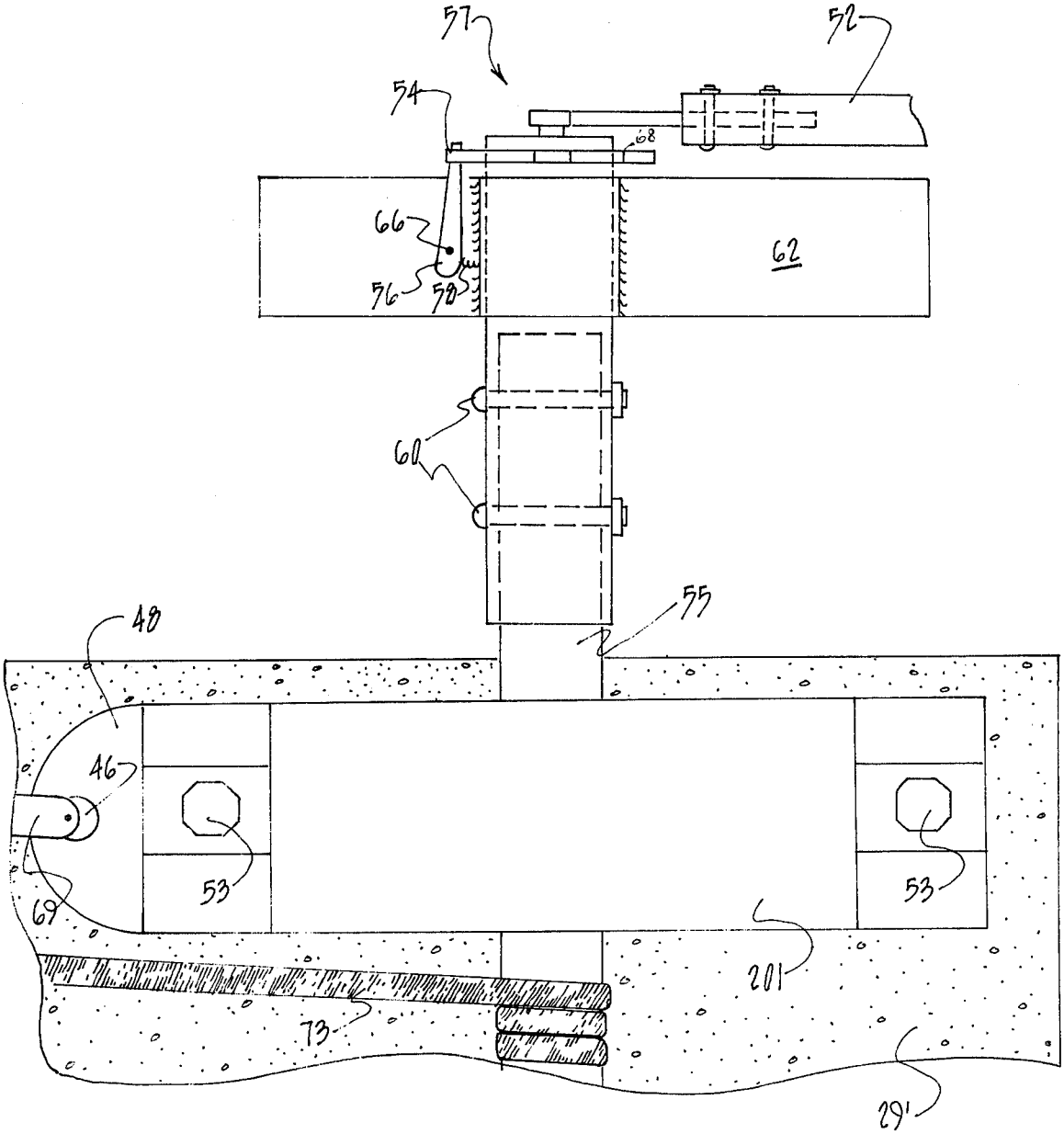
FIG. 7 is a top plan view of an embodiment of a portion of the apparatus for constructing a building structure according to this invention.
Figure 8:
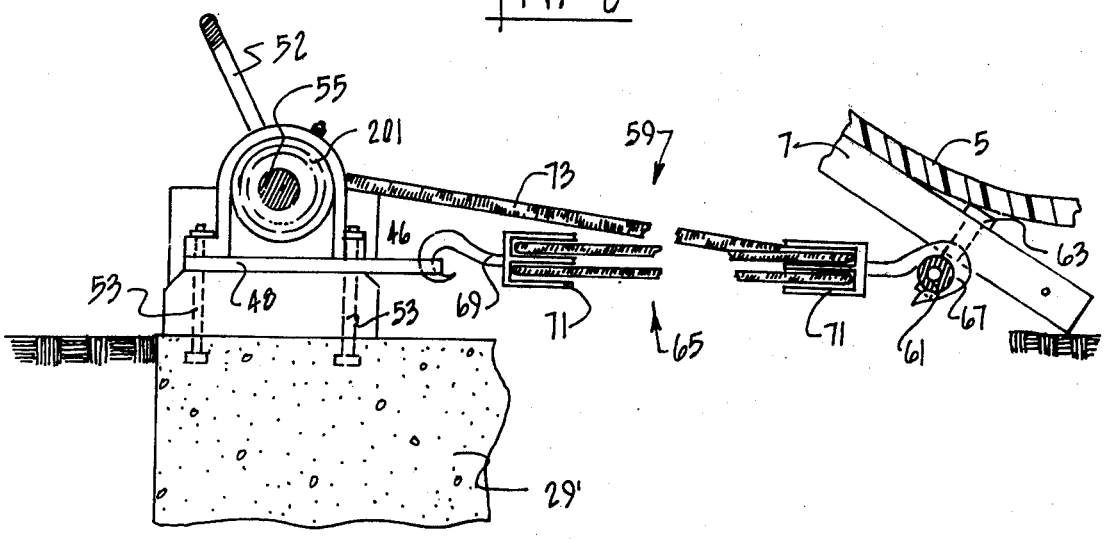
FIG. 8 is a side plan, partially sectionalized view of the apparatus of FIGS. 5 and 7.

Means 59 further includes a block and tackle assembly generally illustrated at 65 (FIG. 8) comprised of a free end hook 67, a footing hook 69, two blocks 71 and tackle (rope or line) 73 arranged by known techniques to optimize the mechanical advantage of assembly 65. Tackle 73 terminates at and is windably connected to rotatable shaft 55 (FIG. 7). In the illustrated embodiment there is a specific block and tackle assembly 65 for each support member 7. While this optimizes stability and safety during flexing and drawing, it is not always necessary. At times, depending on the structure and strength of supports 7, less than this number of assemblies 65 may be employed. Likewise, the illustrated embodiment shows a two-pulley block for a relatively high mechanical advantage. This is not always necessary, and less pulleys may be used depending upon what is needed to safely erect the building.

To support and stabilize rotatable shaft 55 there is provided a series of pillow blocks 201 of conventional design. Pillow blocks 201, such as those produced by Browning Corp. under Model No. PB350 are formed of a malleable housing with self-aligning bearings and are employed by attaching them to footing 29' via bolts 53 that later serve to hold brackets 51 in place (FIG. 12). As illustrated there is one pillow block 201 for each footing 29'. Bolts 53 also provide a retaining mechanism for plate 48 provided with hook hole 46 for securing hook 69 and thus means 59 to footing 29'.

Figure 9:
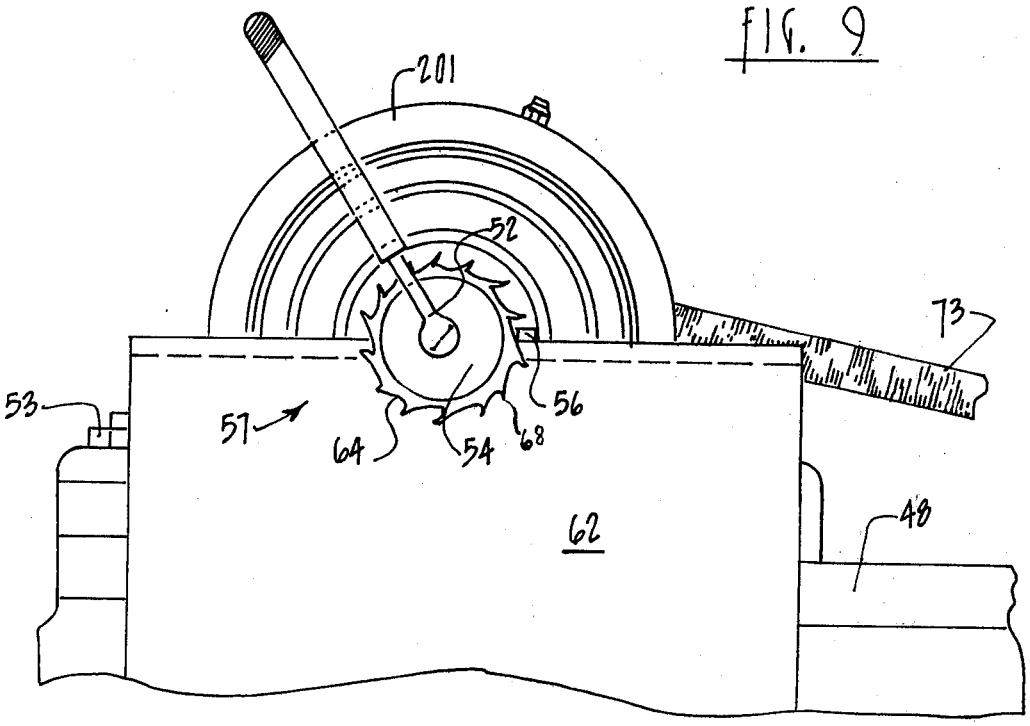
FIG. 9 is a partial side plan view of the apparatus of FIG. 8.

Means 57 located at one or both ends of shaft 55 includes a conventional ratchet assembly best illustrated in FIGS. 7 and 9. The assembly is comprised of a ratchet wheel 54, a one-way ratchet wrench and handle 52, a pawl 56, a spring 58 for retaining pawl 56 in contact with ratchet wheel 54, bolt means 60 for connecting tubular shaft 55 to means 57, and table 62 for retaining and locating pawl 56. Table 62 is usually a simple metal angle iron.

Upon turning ratchet wrench 52 in the appropriate direction (counter-clockwise in FIG. 9), shaft 55 is rotated causing tackle 73 to wind around shaft 55, thereby drawing the free ends of supports 7 toward footings 29'. Whereas one ratchet means 57 is sufficient to draw the free ends of supports 7 toward footings 29' in some embodiments, for large structures, a second ratchet means 57 may be connected to the opposite end of shaft 55 so that when wrenches 52 are rotated in unison, drawing of the free ends of supports 7 may be facilitated more easily. Alternatively, an electric motor may be utilized in place of ratchet wrench 52 so as to provide a constant uniform drawing of the free ends of supports 7. In this respect, the entire means 57 can be replaced by a self-locking motor if desired.

Ratchet wheel 54 includes inclined teeth 68 so as to force pawl 56 outwardly upon counter-clockwise rotation, thereby rotating pawl 56 about pin 66 and compressing spring 58. Upon passing the point of tooth 68, pawl 56 is forced into groove 64 of tooth 68 by compressed spring 58 so as to prevent ratchet wheel 75 from "sliding back" (turning in the clockwise direction in FIG. 9). The system described above allows the person turning ratchet 52 or the electric motor utilized to be given a rest and/or to stop and hold the free ends of supports 7 at their precise location between brackets 37 until they are anchored by pins or bolts 39.

As can be seen, upon anchoring supports 7 at location "A" and initially elevating the structure by way of means 21, handle 52 (or motor) is operated so as to rotate shaft 55. Tackle 73 winds about shaft 55, drawing the free end of support 7 inwardly until it locates between brackets 37 as illustrated in FIG. 12. Supports 7 are thereby flexed into rigid, tensioned supporting members capable of supporting the structure without cross-members. Supports 7 are anchored by bolts or pins via holes 39 and 39'. The block and tackle arrangement is then dismantled, pillow blocks 201 removed, and in those instances where supports 41 are employed, they are anchored after brackets 51 are secured in place.

In this way a building structure 1 which is rigid, capable of satisfying building codes, and yet which is easily mountable and demountable is erected. For demounting one merely needs operate the apparatus just discussed in reverse. That is, hook it up as described after releasing the lower ends of brace members 41 and then slowly release the wound line 73 on shaft 55.

As previously described, the constructed building structure may assume a variety of different configurations. FIGS. 15 through 18 illustrate an apparatus for constructing a semi-hemispherical building structure 91. The panel structure includes a circular sheet 5 having radially extending supports 7 connected to center ring 93 attached thereto, as hereinbefore described.

The apparatus includes a tubular shaft 109, a ratchet means generally illustrated at 105 connected to one end of the shaft 109, and means 107 for substantially simultaneously drawing the unattached ends of the support members 7 toward the attached ends.

In certain preferred embodiments of this invention, means 107 for substantially simultaneously drawing the unattached ends of the elongated flexible support members 7 toward the attached ends comprises a block and tackle assembly comprised of hook 111 connected to the unattached end of support member 7 at bolt or hollow pin 113 and another hook 115 connected to a stationary base 117 secured to foundation 119 located in the center of the floor of the dome. Tackle 121 is wound around tubular shaft 109 which is mounted to foundation 119 by any suitable means 129. Tubular shaft pin 110 extends upwardly from mounting 129 through a hole in mounting table 123 which includes table top 125 and legs 127 attached to stationary base 117. A plurality of stationary bases 117 are provided to allow for a block and tackle assembly for each support member.

Shaft pin 110 is connected to a conventional ratchet means 105 (or motor) as previously discussed. Ratchet means 105 may comprise a ratchet wrench and handle 132 attached to ratchet wheel 131 with inclined teeth 137, and a pawl 133 and an elongated spring 135 so that when ratchet wheel 131 is turned in the appropriate direction, the inclined teeth 137 push pawl 133 out, thereby stretching spring 135. As inclined tooth 135 passes pawl 133, pawl 133 is forced into the groove in tooth 135 by stretched spring 133 so as to prevent ratchet wheel from turning in the opposite direction, as previously described in this application.

With regard to the operation of the apparatus, it can be seen that when handle 132 of ratchet 105 is turned in the appropriate direction, shaft 109 is rotated, thereby winding tackle 121 of block and tackle assembly 107 about shaft 109, causing the unattached ends of support members 7 to be drawn simultaneously toward the attached ends. As a result, support members 7 are forcibly flexed with flexible sheet 5 into a hemispherically domed building structure 91 comprising rigid arch members capable of withstanding substantial load-bearing capacity and capable of preventing longitudinal, lateral and vertical movement, independent of additional interfering columnar or cross member supporting structure.

As previously described, in the preferred embodiment of this invention, support members may be supplemented by brace members 99 pivotally attached thereto at one end and unanchored at the other end for further stabilizing the building structure 91 during construction and thereafter enhancing the stability of the completed building structure 91. The resulting building of structure 91 is capable of withstanding increased vertical and horizontal loads as the result of snow, wind, or otherwise.

Alternatively, a donut-shaped domed building structure 103, as illustrated in FIG. 20, may be constructed as illustrated in FIG. 19. In the preferred embodiment, the apparatus for constructing building structure 103 remains substantially the same as the apparatus for constructing the semi-hemispherical building structure 91 as illustrated in FIG. 18. In the donut dome the anchored ends of supports 7 are not attached to a central elevatable ring 93. Rather, they are connected as shown for example by the mechanism of FIG. 10 to footing 119. Bases 117 are offset so as to interfere with this anchoring. As previously stated, sheet 5 is left as a flap so that the block and tackle arrangement can extend thereunder.

Footing 119 may be constructed so as to either accumulate water or prohibit water buildup. For example, footing 119 may be a series of individual footings for each support 7 so that the ground "G" will absorb rain water. Alternatively footing 119 may be of an elaborate construction so as to act as a conduit or reservoir for snow or rain removal or retention. Many alternatives to the basic structures described may be employed. For example, double shell constructions may be erected by the methods and apparatus of this invention. The buildings themselves may be provided with energy conserving devices. All of this becomes uniquely possible in view of the strength, yet lightness and simplicity of these buildings and their construction.

Once given the above description, various other modifications, features and improvements will become apparent to the skilled artisan. Such other features, modifications and improvements are considered a part of this invention, the scope of which is to be determined by the following claims.

I claim:

1. A method of constructing a self-supporting, mountable and demountable prefabricated building structure which includes a flexible integral sheet and a plurality of elongated flexible support members attached thereto the steps comprising:

a. attaching brace members to at least some of said flexible support members at one end of said brace members thereby defining an attached end and an unanchored end of said brace members,
b. positioning the sheet and support members over the area to be covered by the building,
c. securing one of the ends of the support members against lateral movement, thereby to define a secured end and a free end of each of the support members,
d. elevating a portion of the support members to a height less than the peak of the completed building,
e. drawing substantially simultaneously each of the free ends of said members against the secured ends until a building of the desired size is obtained,
f. stabilizing the building structure during construction by forming supports for said structure with the brace members while drawing the free ends of the support members against their secured ends,
g. anchoring the free ends of said support members, and
h. thereafter anchoring the unanchored ends of the brace members to thereby form said building structure.

2. The method of claim 1 wherein a brace member is pivotally attached intermediate the ends of each of said elongated flexible supporting members, and stabilizing the structure includes inclining some of the brace members toward the center of said building structure and inclining the remaining brace members toward the ends of said elongated flexible supporting members during the drawing operation.

3. The method of claim 2 wherein at least every third brace member is inclined toward the center of said building structure.

4. The method of claim 1 which further includes stabilizing said structure by stressing said flexible integral sheet from end to end.

5. The method of claim 4 wherein said stabilizing includes attaching means to the arched ends of said flexible integral sheet and tightly anchoring said means.

6. The method of claim 1 wherein said building structure is of substantially large size.

7. The method of claim 6 wherein said building spans, widthwise, greater than about 30 feet.

8. The method of claim 1 wherein said building structure is free of any interfering columnar or cross members above ground level yet is capable of satisfactorily withstanding vertical and horizontal loads to which the structure is being subjected and withstanding wind and snow loads without substantial depression.

9. The method of claim 8 wherein said building structure is sufficiently rigid to comply with the applicable structural requirements of building codes for that structure.

10. The method of claim 9 wherein said building structure is capable of withstanding a horizontal load of at least about 25 lb./ft.

11. An apparatus for constructing a self-supporting, mountable and demountable prefabricated building structure which includes a flexible integral sheet and a plurality of elongated flexible support members attached thereto, the apparatus comprising:

a. means for securing one of the ends of the support members against lateral movement, thereby to define a secured end and a free end of each of the support members,
b. means for elevating a portion of the support members to a height less than the peak of the completed building,
c. means for drawing the free ends of the support members substantially simultaneously against the secured ends until a building structure of the desired size is obtained,
d. brace members pivotally connected at one end to a portion of said support members intermediate the ends thereof, and
e. means for anchoring the free ends of the supporting members.

12. The apparatus of claim 11 wherein said drawing means includes:

a. a rotatable shaft member, b. means for rotating said shaft member, c. means for connecting the free ends of the support members to the rotatable shaft in such a fashion that when the shaft is rotated the drawing operation is accomplished.

13. The apparatus of claim 12 wherein said rotatable member extends perpendicularly of said support member, said means for rotating the shaft member includes a ratchet means connected to the shaft and said connecting means includes a block and tackle mechanism connected to the free end of said support member, anchored at the other end, and having its tackle windably connected to said shaft member.

14. The apparatus of claim 13 wherein the block and tackle mechanism is anchored at a point inwardly of the building beyond the point to which the free ends of the support members are to be drawn and anchored.

15. The apparatus of claim 14 wherein the block and tackle mechanism is connected to the free end of said support member at a point sufficiently elevated so as not to interfere with the means for anchoring the free ends when drawn to their desired location.

16. The apparatus of claim 15 wherein said anchoring means includes a pair of spaced plate members between which the free ends of the support members are drawn and to which the free ends are anchored.

17. The apparatus of claim 15 which further includes a free-end shaft extending perpendicularly of the support members, located in the vicinity of and integrally connecting the free ends of all of the support members, said block and tackle mechanism being connected to the free ends of said support members via said free-end shaft.

18. The apparatus according to claim 13 wherein said ratchet means includes a toothed ratchet wheel, reciprocal means for allowing said wheel to be rotated in only one direction, and means for rotating said ratchet wheel.

19. The apparatus of claim 11 wherein said building structure is of substantially large size and comprises a plurality of elongated flexible support members and flexible integral sheets interconnected in end to end relationship, each flexible integral sheet and its respective support members being rollable into a compact transportable configuration when not in use as a building, wherein said building structure when constructed is forcibly flexed as a unit into an arcuate configuration with the elongated flexible supporting members flexed along their respective longitudinal axes into rigid arch members and to withstand wind and snow loads without substantial depression, thereby forming a rigid unitary self-supporting arcuate permanent or stabile building independent of additional interfering columnar or cross member supporting structures.

20. The apparatus of claim 11 wherein said building includes stabilizing means which stress the flexible integral sheet from end to end.

21. The apparatus of claim 20 wherein said stabilizing means is attached to the arched ends of said flexible integral sheet and tightly anchored at the opposite ends of said stabilizing means, thereby forming a unitary arcuate building structure capable of withstanding wind and snow loads without substantial depression.

22. The apparatus of claim 20 wherein said stabilizing means comprises means attached to the arched ends of said flexible integral sheet and tightly anchored by anchoring means, thereby forming an enclosed unitary arcuate building structure.

23. The apparatus of claim 11 wherein said building structure is sufficiently rigid to comply with the structural requirements of applicable building codes for that structure.

24. The apparatus of claim 23 wherein said building structure is semi-cylindrical in shape.

25. The apparatus of claim 23 wherein said building structure is a semi-hemisphere.

26. The apparatus of claim 23 wherein said building structure is donut-shaped.

* * * * *